US005749190A

United States Patent [19]

Williams

[11] Patent Number: 5,749,190

[45] Date of Patent: May 12, 1998

[54] HVAC REGISTER BOX

[76] Inventor: Steven Ray Williams, 8171 Ellington Ave., Hilmar, Calif. 95324

[21] Appl. No.: 359,063

[22] Filed: Dec. 19, 1994

[51] Int. Cl.[6] ..... E04F 17/04

[52] U.S. Cl. ..... 52/302.1; 52/302.7; 454/330; 72/379.2

[58] Field of Search ..... 52/302.1, 301.7; 72/379.2, 379.9; 39/509, 897, 897.1; 454/284, 292, 330

[56] References Cited

U.S. PATENT DOCUMENTS

| | | | |
|---|---|---|---|
| 820,976 | 5/1906 | Kotzinger | 72/379.4 |
| 4,088,463 | 5/1978 | Smith | 454/292 X |
| 4,305,340 | 12/1981 | Iwaki et al. | 72/379.4 |
| 4,754,696 | 7/1988 | Sarazen et al. | 52/302.1 |
| 4,858,520 | 8/1989 | Prochnow et al. | 454/284 X |

*Primary Examiner*—Wynn E. Wood
*Assistant Examiner*—W. Glenn Edwards
*Attorney, Agent, or Firm*—J. L. Bohan

[57] ABSTRACT

An HVAC register box having no welded or riveted corners and the process for making same by means of fabrication from a single sheet of material without cutting. The highly simplified process for fabrication produces a register box which has superior rigidity and resistance to air leakage at the joints or corners.

2 Claims, 2 Drawing Sheets

HVAC REGISTER BOX

FIELD OF INVENTION

The present invention relates to an improved register box used in heating, ventilating and air conditioning (HVAC) systems for the purpose of introducing heated or cooled air into a room to control its temperature. More particularly it relates to a register box made from a single sheet of uncut rectangular metal.

BACKGROUND OF THE INVENTION

At the present time register boxes are constructed of 26 or 30 gauge sheet metal by means of joining overlapping tags of the metal at the corners of the box by means of spot welding or riveting. Although such boxes are generally effective for their intended purpose, over long periods of usage they tend to exhibit joint failure and permit conditioned air to leak and impinge on the structural members of the building.

In the winter, hot air is repeatedly cycled from the central furnace to the register box via an air duct. In the course of a day, each register box will go from a temperature in the 60 degrees Fahrenheit range to over 150 degrees and then back down to 60 degrees several dozen times. Many boxes are made of light gauge sheet steel and the coefficient of expansion of this material is such that each heating and cooling cycle introduces stress to the spot welds or rivets located at the corner joints.

When the humidity of the air being heated is relatively high, moisture is deposited on cooler members in the HVAC system such as register boxes when the warm air first reaches it. For this reason, the sheet metal, when made of steel, is usually galvanized. However at the spot weld or rivet, the galvanized surface is disturbed which provides a point of access for moisture to reach the base metal. Over time the metal around the spot welds begin to experience corrosion and eventual failure permitting the corner joint to open. In a riveted joint the rivets themselves often corrode. The end of the rivet is stressed as a result being hot or cold worked and moisture will preferentially corrode the locus of such stress causing the rivet to fail.

In the summer the register box is cooled by conditioned air and such temperature cycling similarly introduces stress to the corner components. The conditioned air, however, usually has much of the moisture removed at the condenser coils. The ambient air will move into the register box after the circulating blower goes off and, in humid weather, condensation will occur on the cooler box surfaces thus promoting corrosion.

SUMMARY OF THE PRESENT INVENTION

The HVAC register box of the present invention is formed into a rectangular shape without using spot welding, rivets or the like at the corners. The box is formed from a single sheet of rectangular metal without cutting as described below. The corners are created by retaining the extra metal that forms at the corners and bending it to lay substantially flat against an adjacent side. This creates a leak-proof corner without a seam or joint that could one day open up and cause air leakage to surrounding structural members of the building.

DESCRIPTION OF A PREFERRED EMBODIMENT

Figure 1:
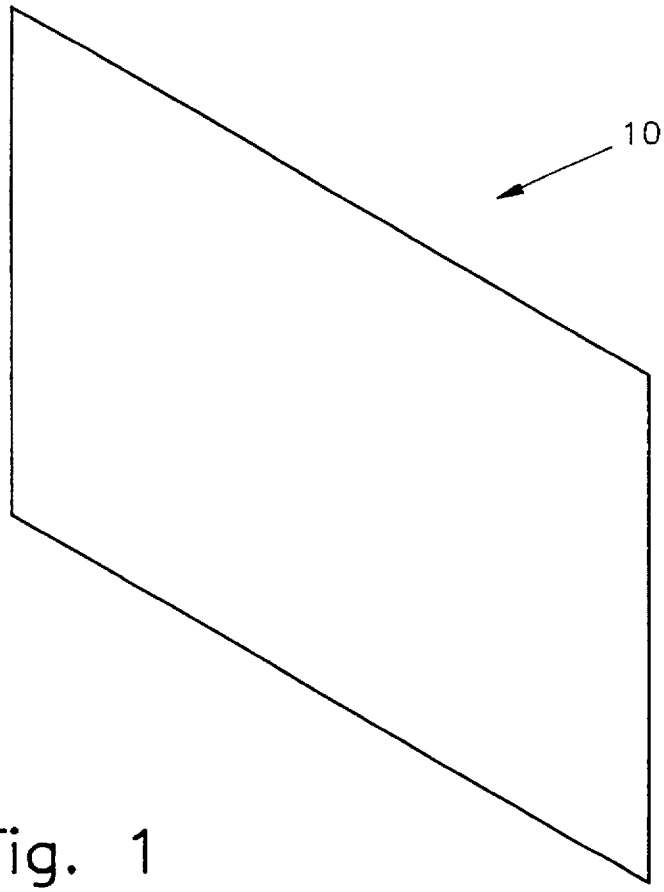
FIG. 1 is a view of a piece of flat rectangular sheet metal.
Figure 2:
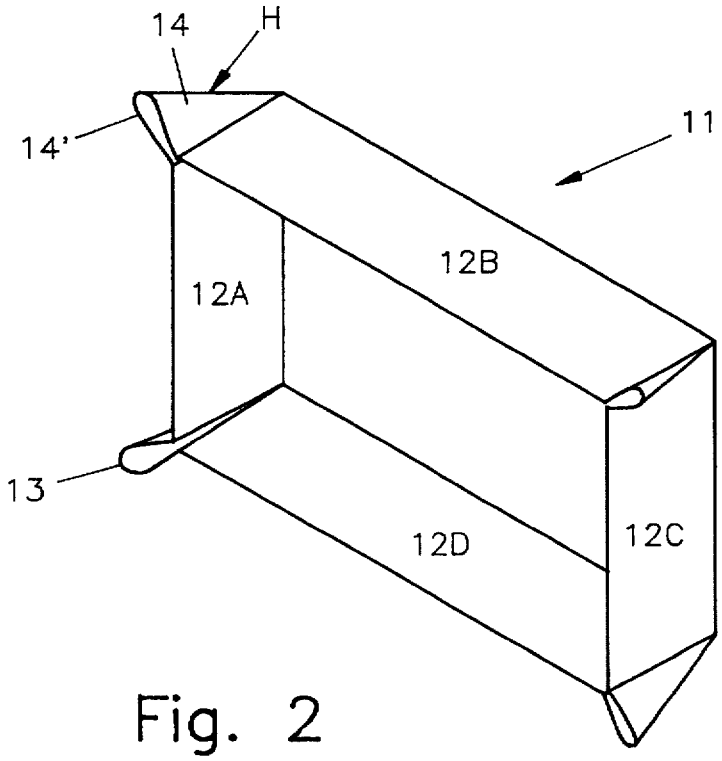
FIG. 2 is a view of the sheet metal of FIG. 1 after being formed into a rectangular box by a press.

Referring to FIG. 1 a box of the present invention starts with a single rectangular piece of sheet metal 10 having a predetermined thickness, typically 26 or 30 gauge. This sheet is cold or hot formed in a die press to form a generally rectangular box 11 with four rectangular shaped sides 12A, 12B, 12C and 12D as depicted in FIG. 2. As a result of the forming operation, four tabs 13 are created, one at each corner. These protruding, excess-metal members 13 are not cut off or otherwise removed but are retained as part of the structural system of the box. By not cutting members 13, no open joint or seam is created that could later become a conduit for air leakage.

Figure 3:
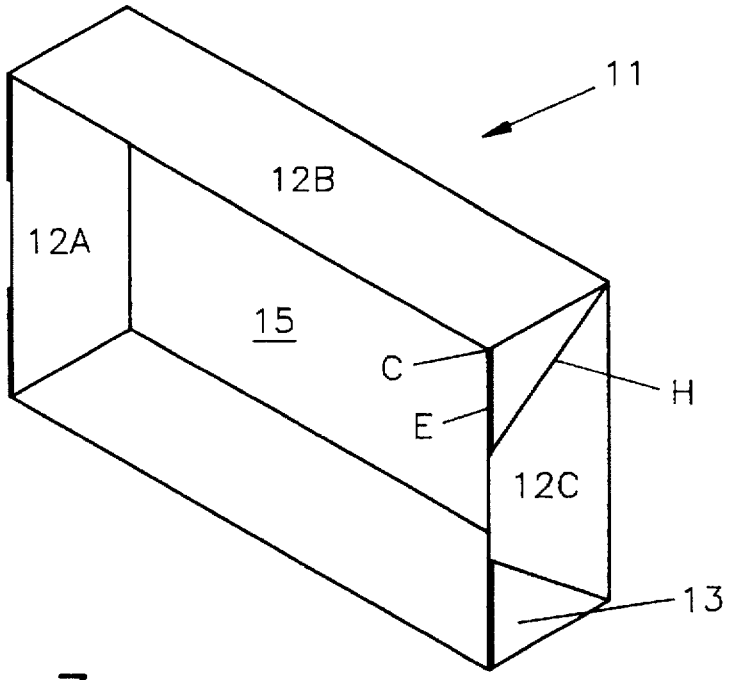
FIG. 3 is a view of the box of FIG. 2 showing the corner tag compressed and laying against an adjacent side.

Members 13 are squeezed shut so that the two triangular shaped sides 14 and 14' are forced into contact and are naturally and automatically joined at the hypotenuse to form a continuous fluid seal. The excess-metal member 13 produced thereby is basically triangular in shape and of double thickness. The thus flattened member 13 is, as shown in FIG. 3, bent so that it is caused to lay substantially flat against an adjacent side. As used herein, the expression "continuous, double-thickness, excess-metal member of triangular shape" shall mean the flattened triangular tab 13 as shown in FIG. 3 wherein a continuous fluid seal of adjacent rectangular sides is effectuated at the common hypotenuse H. Over time, the register box can become warped due to settling of the framing, thermal cycling of the box etc. This could cause, for example, sides 12B and 12C to pull apart somewhat creating an opening at the internal surface of the box at corner C. Any air inside the box which attempts to leak through at inside corner C, upon reaching the hypotenuse H will encounter a continuous seal. The only outlet for such diverted air is via the opening at the base of the two triangles 14 and 14' (see FIG. 2); accordingly, the air will rejoin with the main flow of air and pass through the register and not become diverted into the surrounding framing.

The four members 13 could be bent in the same direction so that each rectangular side has one continuous, double-thickness, excess metal member of triangular shape 13 pressed against it. As depicted in FIG. 3, it is usually preferred to bend the members 13 to the short rectangular sides 12A and 12C of the register box to facilitate its installation in the wood framing that holds the box in place.

Figure 4:
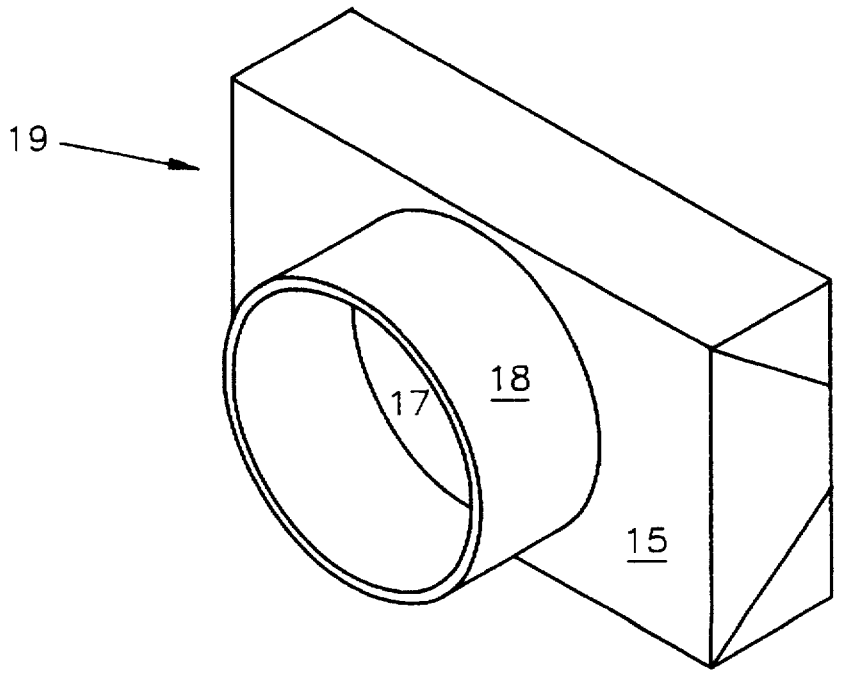
FIG. 4 is a view of the register box of the present invention with a circular collar.

The rectangular-shaped inlet side 15 opposite to the rectangular, open side is shown in FIG. 3. Normally a register box is, as shown in FIG. 4, provided with a generally centrally located circular opening 17. This opening 17 is for the purpose of accommodating cylindrical collar 18 which is joined by conventional means to the incoming duct pipe, either rigid or flexible.

The improved register box 19 of the present invention is of superior strength due to the retention of the excess-metal corner members 13; the overall rigidity of the box 19 is materially enhanced and is easier to install without bending or warping the metal sides in the process. Having no seam, the air moving through the box has no opportunity to escape and impinge upon structural members of the building. Also having no spot welds or rivets, box 19 is not subject to eventual failure of these connectors since there are none.

Register boxes 19 can be made from galvanized sheet steel but can also be made of aluminum or other metals and still realize the improvements stated above. Although steel sheet metal, 26 and 30 gauge in thickness, is commonly used for register boxes, the box of the present invention can be made a heavier gauge material. If the register box of the present invention is made of heavier material, it may be necessary to anneal or normalize the box in order to relieve the stresses introduced to the continuous, double thickness, excess-metal member of triangular shape 13 to reduce the chance of water-condensate causing stress corrosion. This is especially so if the forming process is not done at elevated temperatures such as by cold working.

Although the above describes a basic rectangular register box, the principles disclosed above can be used to form other components of an HVAC system; for example plenum boxes that may have more than one opening for accommodating several collars could be formed from a single piece of sheet metal in accordance with the above teachings.

Register boxes today are framed in and affixed to the wood framing surrounding it. The register is then affixed to the wood framing after the sheet rock is in place. In older homes, the register is affixed directly to flanges on the face of the register box by means of screws. The register box of the present invention may be used for remodeling projects in older homes by simply affixing a bracket or flange to several open edges of the box to align with the holes in the register.

Having thus described the invention, variations thereto will occur to those skilled in the art without departing from the spirit and scope of the following claims.

I claim:

1. An HVAC register box consisting of a hollow six-sided metallic box open on one side comprised of:

a.) four rectangular-shaped sides which meet at substantially right angles to form four corners;

b.) a rectangular-shaped inlet-side with at least one opening for accommodating incoming HVAC ductwork;

c.) one rectangular-shaped, open-side for receiving the register opposite to the inlet-side; and d.) a continuous, double-thickness, excess-metal member of triangular shape located at each said corner lying flat against an adjacent rectangular side.

2. A process for forming an improved HVAC register box of the type comprised of a hollow, six-sided metallic box with four rectangular-shaped sides, a rectangular-shaped inlet-side with at least one opening for accommodating incoming HVAC ductwork and one rectangular-shaped, open-side for receiving the register opposite to the inlet-side, the process comprising forming the register box from one sheet of rectangular metal by:

a.) bending up the four sides of a rectangular sheet of metal of predetermined dimensions and thickness so that four rectangular sides are formed that meet substantially at right angles to each adjacent side and the inlet-side thereby forming a rectangular open-side opposite to the inlet-side and as a result of such bending creating four excess-metal members protruding from each corner b.) compressing each said protruding excess-metal member to form a continuous, excess-metal member of triangular shape that has a thickness that is double said predetermined thickness and c.) bending each excess-metal member to one of the adjacent rectangular-shaped sides whereby in the course of bending such excess-metal member plastic deformation occurs at the corner to cause such member to lay substantially flat against the adjacent side to which it is bent.

* * * * *